United States Patent [19]

Stauber

[11] Patent Number: 4,703,901

[45] Date of Patent: Nov. 3, 1987

[54] APPARATUS FOR EXCHANGING WINDING FRAMES AND USED AT A WINDING STATION FOR PRINTED PRODUCTS

[75] Inventor: Hans-Ulrich Stauber, Grüt, Switzerland

[73] Assignee: Ferag AG, Hinwil, Switzerland

[21] Appl. No.: 34,623

[22] Filed: Apr. 6, 1987

[30] Foreign Application Priority Data

Apr. 14, 1986 [CH] Switzerland ..... 1474/86

[51] Int. Cl.[4] ..... B65H 75/00; B65G 37/00

[52] U.S. Cl. ..... 242/59; 242/58.6; 242/79; 198/468.9; 198/457

[58] Field of Search ..... 242/55, 59, 58.6, 79; 414/222, 277–280; 198/468.9, 457

[56] References Cited

U.S. PATENT DOCUMENTS 3,695,532 10/1972 Lindstaedt ..... 242/58.6 X
3,695,539 10/1972 Lindstaedt ..... 242/58.6
4,187,942 2/1980 Ward ..... 414/222 X
4,555,067 11/1985 Angelucci et al. ..... 414/222 X
4,629,057 12/1986 Jensen et al. ..... 198/468.9 X

*Primary Examiner*—John M. Jillions
*Assistant Examiner*—Steve Dubois
*Attorney, Agent, or Firm*—Werner W. Kleeman

[57] ABSTRACT

At a winding station for printed products a mobile winding frame coupled with the winding station is to be removed and exchanged for a winding frame which is to be coupled in its stead with the winding station. For this purpose there is provided an entrainment carriage moveable along a substantially linear path of travel and which can be coupled with an associated one of the winding frames and selectively can be moved towards and away from the winding station. There is additionally provided for such winding frame removal and exchange operation a platform which can be moved into and laterally out of the linear path of travel of the entrainment carriage at the region of the winding station. This platform serves for the reception of an emptied winding frame. The platform is preferably constructed in the manner of a low or ground-near carriage which travels upon wheels.

15 Claims, 6 Drawing Figures

APPARATUS FOR EXCHANGING WINDING FRAMES AND USED AT A WINDING STATION FOR PRINTED PRODUCTS

CROSS REFERENCE TO RELATED APPLICATIONS

This application is related to the commonly assigned U.S. application Ser. No. 06/677,564, filed Dec. 3, 1984, and entitled "METHOD AND APPARATUS FOR SUPPLYING PRINTED PRODUCTS TO A CONTINUOUSLY OPERATING PROCESSING LINE", and the commonly assigned U.S. application Ser. No. 07/005,693, filed Jan. 22, 1987, and entitled "APPARATUS FOR WINDING A CONTINUOUSLY ARRIVING IMBRICATED FORMATION OF FLEXIBLE FLAT STRUCTURES INTO A WOUND PRODUCT PACKAGE".

BACKGROUND OF THE INVENTION

The present invention relates to a new and improved construction of an apparatus for exchanging winding frames at a winding station.

In its more particular aspects, the present invention relates to a new and improved construction of an apparatus for exchanging at a winding station for printed products or the like a mobile winding frame which is to be removed from the winding station and replaced with a mobile winding frame which is to be operatively coupled at the winding station.

In the context of this disclosure it is to be understood that the term "winding station" is not limited to a structure where there is only performed a winding-up of the printed products or the like, but also covers a structure where there is unwound the printed products or the like.

Additionally, in the context of this disclosure the term "winding frame" is not to be construed in a limiting sense as strictly relating to a frame which carries a wound package which has been wound there upon, but also is intended to cover to the extent appropriate a frame which is empty, in other words from which the wound package has been previously unwound or at which a package has not yet been wound up.

Printed products which are to be stored in the form of a product package which is wound upon a winding core or mandrel instead of in the form of a conventional quadrangular-shaped stack is known in this technology, for instance, from Swiss Pat. No. 642, 602, and the cognate U.S. Pat. No. 4,438,618, granted Mar. 27, 1984. Apart from the appreciably greater storage capacity, such type of wound product package, among other things, affords the advantage that the product formation contained in the wound package, and which formation corresponds to the formation in which the printed products usually emanate from the printing press, namely an imbricated product formation, are so to speak to a certain extent "frozen" or preserved in such formation, and during the course of the unwinding of the wound product package can be readily again reestablished.

It is equally known, for instance, from Swiss Pat. No. 652, 699, and the cognate U.S. Pat. No. 4,587,790, granted May 13, 1986, to individually store in a mobile frame such wound packages together with auxiliary devices, in particular in conjunction with a supply roll for the partition or separating band or tape or the like. Wound product packages which are stored in such mobile frames can be easily handled without the requirement of performing additional operations at a finished wound package or at a finished unwound or empty winding core or mandrel. In particular, such mobile frames can be operatively coupled to winding stations, whether they be product wind-up stations or product unwinding stations, which then impart the drive power required for the winding-up or winding-off of the product package, to the auxiliary devices present at the mobile frame.

Although not directly concerned with the underlying concepts of the present invention it is assumed to be helpful if the reader has a knowledge of the subject matter of the aforementioned patent literature, particularly the U.S. Pat. No. 4,438,618, and the U.S. Pat. No. 4,587,790, so that it will be unnecessary to explain how there is formed a package composed of wound printed products, and how such wound packages are again unwound. Equally, it will then be unnecessary to explain in detail the nature of the auxiliary devices or units provided at the mobile winding frame.

The fully wound-up or complete product package has a maximum diameter which is governed by the associated winding frame.

Now, if the problem exists of storing comparatively thick or voluminous printed products in a wound product package or removing them from such wound product package, it should be evident that the number of relatively thick or voluminous printed products which can be stored in one and the same product package is relatively small in comparison to the number of thin printed products which can be stored in a product package of the same dimensions.

Accordingly, the residence or dwell time at the winding station is comparatively short for a winding frame which is provided with or which is to be provided with such a wound product package composed of thick or voluminous products, so that the standstill times of the winding station required for the exchange of the winding frames already corresponds to the order of magnitude of the residence or dwell time of the mobile frame at the winding station when operating or in fact exceeds the same. The heretofore conventionally accomplished exchange of the winding frames was undertaken manually or by means of standard transport facilities, for instance, tractors, forklift trucks or the like.

SUMMARY OF THE INVENTION

Therefore, with the foregoing in mind, it is a primary object of the present invention to provide a new and improved construction of an apparatus for exchanging winding frames at a winding station for products, such as printed products which is not afflicted with the aforementioned drawbacks and shortcomings of the prior art.

Another and more specific object of the present invention aims at the provision of a new improved construction of an apparatus for exchanging winding frames in an apparatus for winding printed products or the like in a manner such that the standstill or down time of the winding station is reduced to a minimum during the exchange of the winding frames.

Yet a further significant object of the present invention is directed to a new and improved construction of an apparatus for exchanging winding frames at a winding station for printed products, which apparatus is relatively simple in construction and design, extremely reliable in operation, quite economical to manufacture, not readily subject to breakdown or malfunction and requires a minimum of maintenance and servicing.

Now in order to implement these and still further objects of the present invention, which will become more readily apparent as the description proceeds, the winding frame exchange apparatus of the present development is manifested by the features that there is provided an entrainment carriage or wagon which is guided along a substantially linear track or path of travel. This entrainment carriage can be operatively coupled with one of the winding frames and can be moved towards and away from the winding station. Additionally, there is provided a platform which can travel into the substantially linear path of travel of the entrainment carriage at the region of the winding station and can move out of such substantially linear path of travel. This platform serves to receive or take up a winding frame which has been processed such as typically, for instance, an emptied winding frame although it is to be understood such processed winding frame also could be a loading winding frame containing a wound product package. This obviously depends upon the relevant mode of operation of the winding station as heretofore defined.

By virtue of the foregoing, it is possible to automate or mechanize the exchange of winding frames at the winding station and thus beneficially utilize the residence or dwell time of a winding frame at the winding station in order to bring into a preparatory position the next winding frame which is to be subsequently exchangeably coupled at the winding station.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
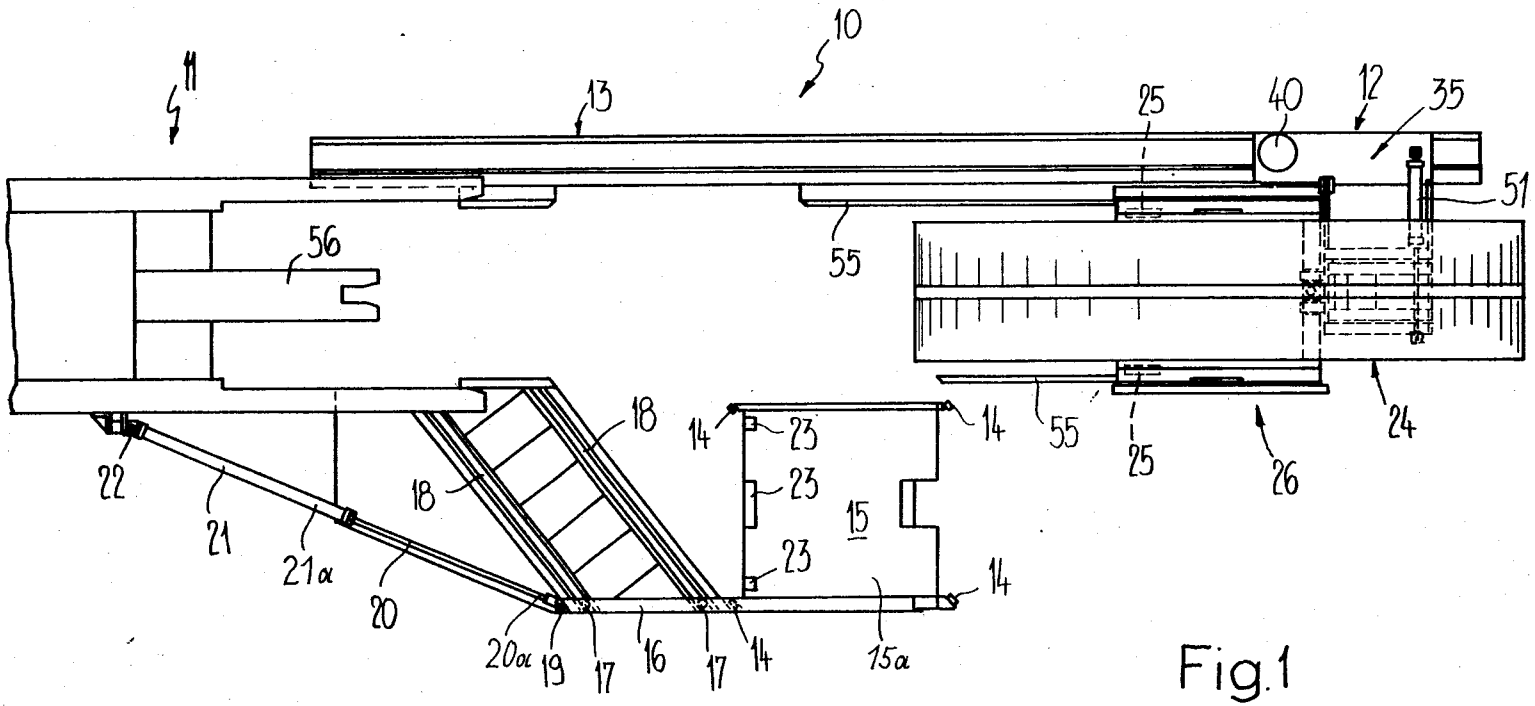
FIG. 1 is a schematic top plan view of a winding frame exchange apparatus in which, for instance, a winding frame containing a complete or full wound package is ready to be moved by means of the entrainment carriage in the direction of a winding station.

Describing now the drawings, it is to be understood that to simplify the showing thereof only enough of the structure of the winding frame exchange apparatus for exchanging winding frames and the associated winding station have been illustrated therein as is needed to enable one skilled in the art to readily understand the underlying principles and concepts of this invention.

Turning now specifically to FIGS. 1 to 4 of the drawings, the apparatus 10 illustrated therein by way of example and not limitation will be seen to comprise a winding station 11, which in the embodiment under discussion constitutes, for instance, a product unwinding or wind-off station. While as a matter of convenience in the following description the winding station 11 will be described in the context of an unwinding station for products, such as printed products, it will be readily apparent to those skilled in the art and from what has been discussed and defined previously, that the apparatus 10 also can be operatively coordinated with a winding station which constitutes a product wind-up station for winding-up products, such as for instance printed products, in which case however, there would be obviously accomplished a different course of movement or operation of its moveable components.

The essential components of the winding frame exchange apparatus will not be considered hereinafter and constitute the following:

A safe-propelling or self-driving entrainment carriage or wagon 12, which will be described in greater detail hereinafter, and which is guided by means of a substantially linear rail or track arrangement 13 to or towards the winding station 11 and away from this winding station 11. Additionally, there is also provided a platform or platform member 15, shown in an empty state in FIGS. 1 and 2, which is supported upon freely rotatable wheels 14. One side of this platform 15 is provided with a cantilever or cantilever means 16. This cantilever or cantilever means 16 is displaceably guided essentially parallel to itself by means of the rolls or rollers 14 in guide rail 5 or guide rail means 18 forming a track. The rotational axes of these rolls or rollers 14 extend, for instance, substantially at right angles or perpendicular to the guide rails or guide rail means 18.

The cantilever or cantilever means 16 is hingedly connected at its end 19 with the free end **20*a* of a piston rod 20 of a double-acting pneumatic or hydraulic piston-and-cylinder unit 21, the cylinder 21*a* of which is articulated or hinged at location 22, in this case is positionally oriented at the winding station 11. If this fluid-operated, that is to say pneumatic or hydraulic piston-and-cylinder unit 21 is impinged with a pressurized suitable fluid medium so as to extend or thrust out its piston rod 20, then the cantilever or cantilever means 16 is moved substantially parallel to itself, and thus also the platform 15 is moved along the guide rails 18 until reaching the terminal end or region thereof, as best seen by referring to FIGS. 1 and 3. Conversely, if the platform 15 is drawn or pulled back toward the winding station 11, then the piston-and-cylinder unit 21 is impinged with the pressurized fluid medium in the sense of retracting or withdrawing the piston rod 20. The guide rails or guide rail means 16 for the platform 15 are directed away from the winding station 11 at an angle of at most 90° with respect to the substantially linear path of travel defined by the substantially linear rail or track arrangement 13 provided for the entrainment carriage or wagon 12**.

Figure 2:
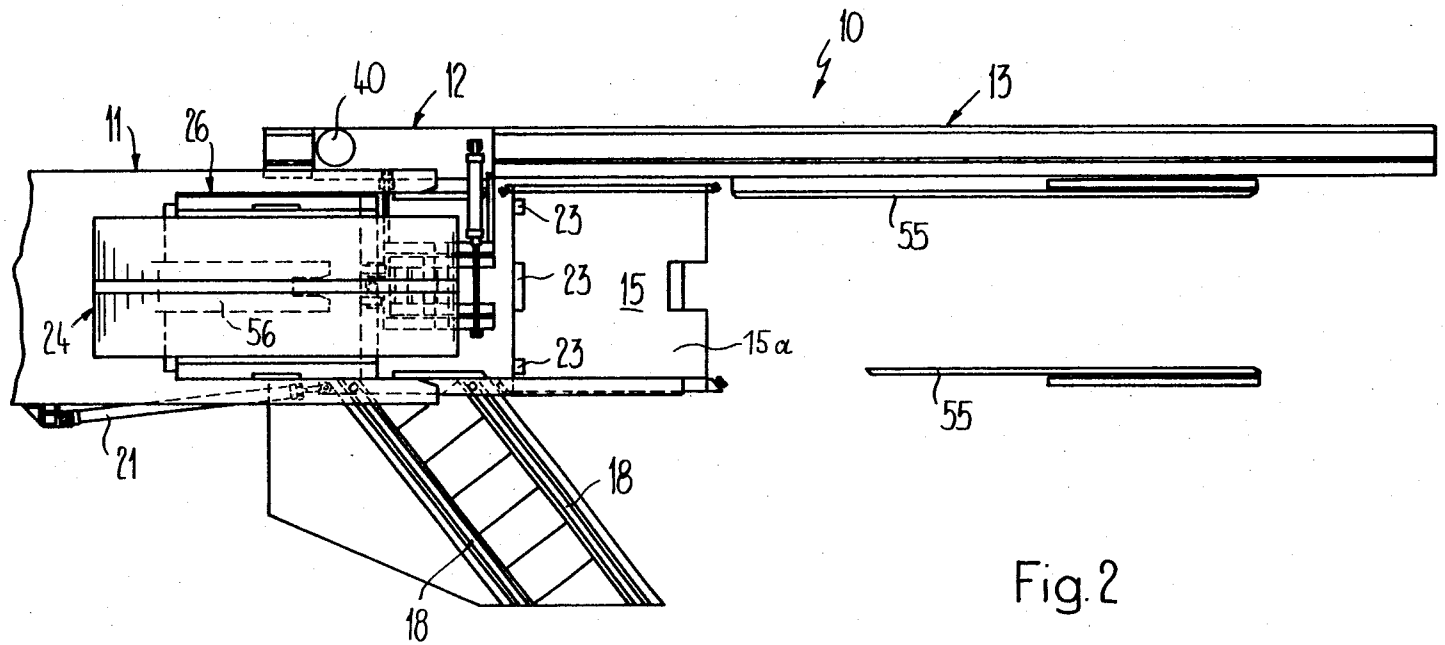
FIG. 2 is a top plan view of the apparatus depicted in FIG. 1 wherein a platform is already located in its traveled or moved-in position at the winding station and is ready for reception of the winding frame which here for instance does not contain any package thereat, in other words constitutes an empty winding frame.

The platform or platform member 15 is structured in the manner of a low or ground-near carriage or wagon, i.e., its support surface 15*a* which is visible in the top plan views of FIGS. 1 and 2 is disposed only several millimeters above the ground or floor or other supporting structure. In order that an empty winding frame from which there has been removed the wound product package so that it no longer contains any wound product package thereon can be heaved or moved onto the platform 15 without any great resistance or difficulty, this platform 15 is beneficially provided with small travel or run-on ramps 23 or equivalent winding frame loading facilities. The spacing of the outer or run-on ramps 23 from one another corresponds to the gauge of the roll or rollers 25 of one of the winding frames 26. As will be demonstrated and explained more fully hereinafter, the rolls or rollers 50 belonging to the mobile entrainment carriage 12 travel upon the intermediate disposed travel or run-on ramp 23.

In FIG. 1 there is shown in top plan view a winding frame 26 which is loaded with a fully or completely wound product package 24. In this regard there is particularly made reference to FIG. 4. It will be understood that each winding frame 26 comprises an essentially quadrangular base or main frame 28 which is supported at two of its corners by means of the rolls or rollers 25 at the floor or ground or supporting structure and at the remaining corners is supported by means of feet or legs 29 or equivalent structure. Two sturdy support legs or leg members 30 which are inclined towards one another extend from the base or main frame 28 at each side or end of the product package 24. Each such pair of support legs 30 is connected at its upper ends with an associated bearing block 31 or equivalent structure. Rotatably mounted in these bearing blocks 31 is the core or mandrel 27 of the wound product package 24. This core or mandrel 27, and thus the wound product package 24 is driveable by means of a sprocket wheel 32, which is rigidly connected for rotation with such core or mandrel 27 and through the agency of a not particularly illustrated but conventional sprocket chain.

Figure 5:
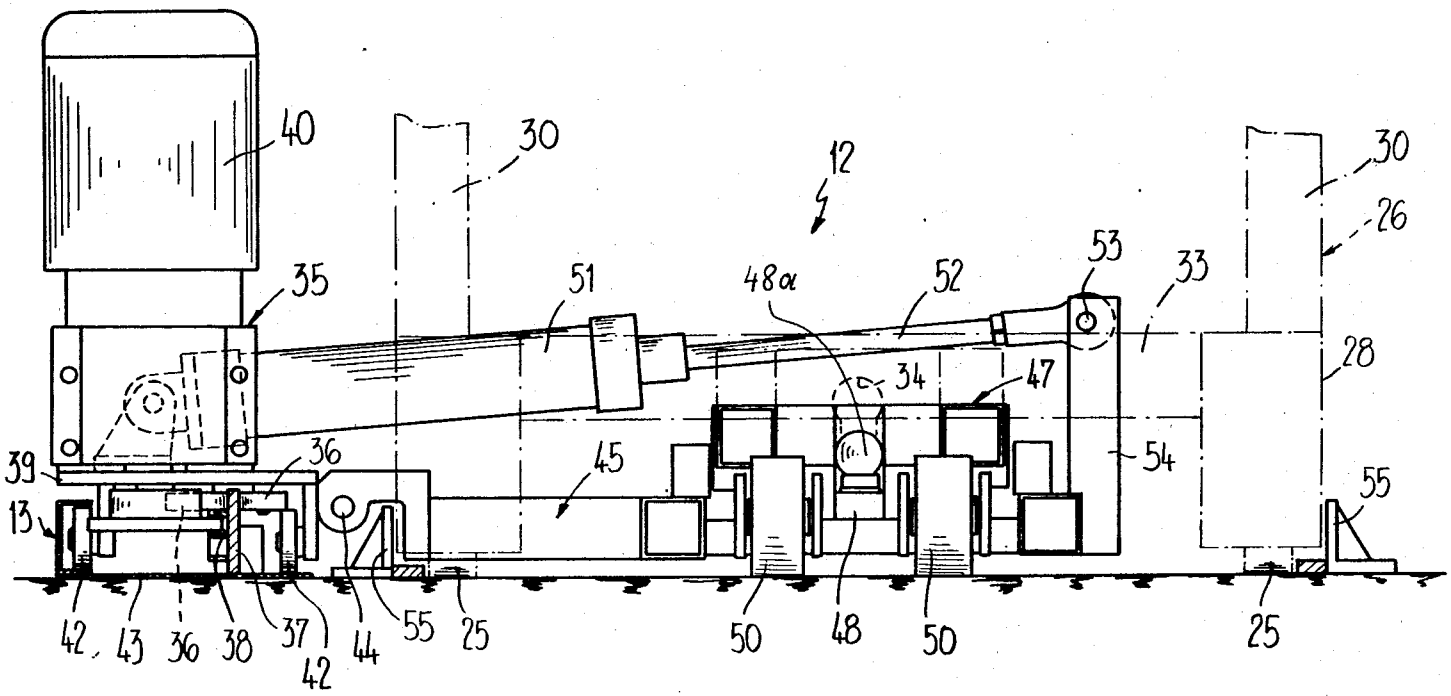
FIG. 5 illustrates on an enlarged scale an end view of the entrainment carriage looking in the direction of the arrow V of FIG. 4.

At the frame corners provided with the legs or leg members 29 the base or main frame 28 possesses a traverse or transversely extending cross bar 33 or equivalent structure, as best seen by referring to FIG. 5, in which there is formed a downwardly open recess or opening 34. This recess or opening 34 forms to a certain extent one-half of a coupling by means of which the entrainment carriage 12 can be coupled or entrainably connected with the winding frame 26.

Figure 6:
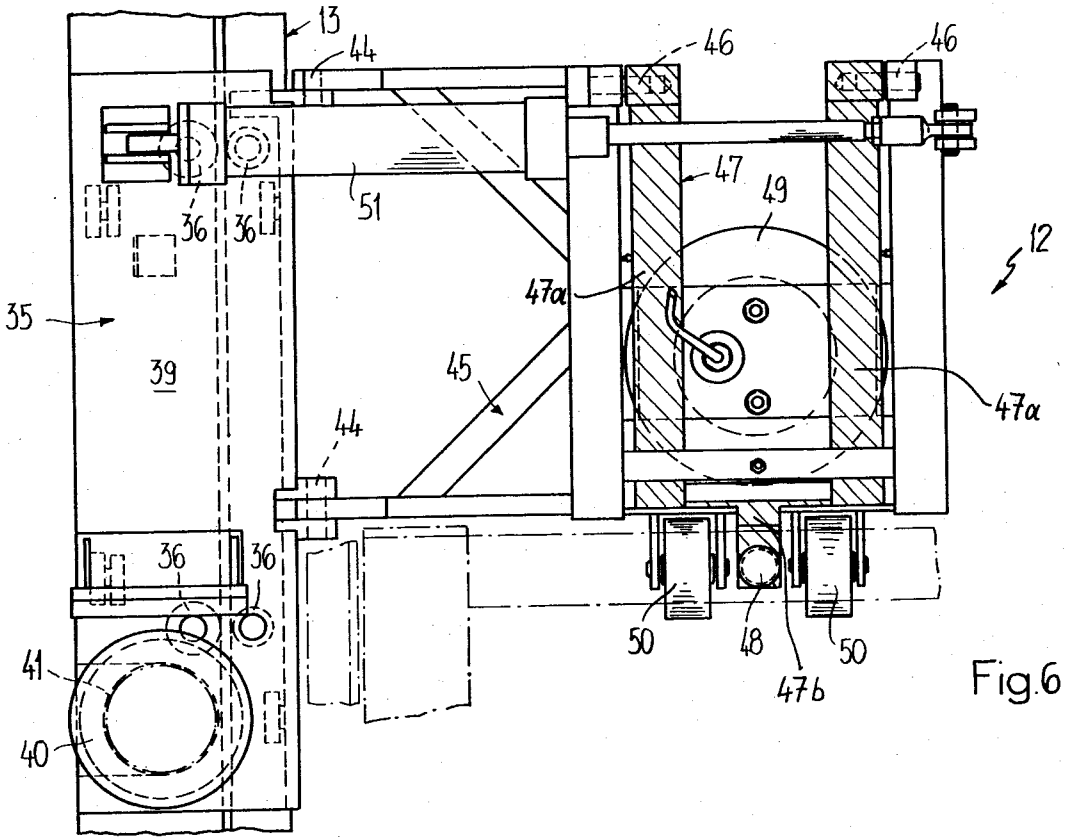
FIG. 6 is a top plan view of the entrainment carriage depicted in FIG. 5.

Reference now will be made to FIGS. 5 and 6. The entrainment carriage 12 possesses a self-propelling or self-driving drive unit 35 which is guided by rolls 36 having substantially vertically extending axes at a vertical leg 37 of the rail or track arrangement or means 13. At the one side of this leg or leg member 37 there is anchored a gear rack 38 which extends over its entire length. This gear rack 38 also could be constituted, for instance, by a welded roll chain or equivalent structure.

At a base plate 39 of the drive unit 35 there is flanged a suitable transmission or gearing motor 40 having a substantially vertically extending axis. At the power take-off shaft of this transmission motor 40, which piercingly extends through the base plate 39, there is keyed or otherwise appropriately secured, a gear 41 which meshes with the gear rack 38 (see FIGS. 5 and 6). Finally, the drive unit 35 is supported by means or rolls or rollers 42 having substantially horizontally extending axes upon a base or floor plate 43, for instance formed of sheet metal or metal plating, of the rail or track arrangement 13.

There is laterally hingedly connected or articulated at the drive unit 35 a main frame or frame member 45 by means of two horizontal pivot pins or journals 44 extending substantially parallel to the rail or track arrangement 13. At the main frame 45 there is hingedly connected by means of the horizontal pivot pins or journals 46, which extend substantially perpendicular to the rail or track arrangement 13 an auxiliary frame or frame member 47. In FIG. 6 as a matter of convenience in the portrayal, although the illustration is not really in sectional view, the auxiliary frame or frame member 47 has been shown for clarity purposes with shade lines extending from the upper left downwardly toward the lower right of the illustration. It will be seen that the auxiliary frame or frame member 47 which possesses an essentially U-shaped configuration, is hingedly connected by means of the ends of its legs 47*a* at the main frame or frame member 45.

At the center or central region of the transverse strut 47*b* which interconnects both legs of the auxiliary frame or frame member 47, there is anchored an upwardly protruding or extending entrainment member or pin 48 or equivalent entrainment or coupling structure, which has a substantially spherical or ball-shaped end 48*a*. The entrainment member or pin 48 and particularly its ball-shaped end 48*a* is intended to engage into the complementary recess or opening 34 of the traverse or cross bar 33, as shown in FIG. 5 in broken lines, and thus forms the second half of the coupling by means of which there can be operatively coupled the entrainment carriage 12 at an associated one of the winding frames or frame members 26.

In order to upwardly pivot the auxiliary frame or frame member 47 and thus for lifting the entrainment member or pin 48 there is provided between the auxiliary frame 47 and a traverse or cross bar of the main frame 45, which engages beneath the auxiliary frame 47, a bellows 49 or equivalent structure which can be impinged with pressurized or compressed air.

The main frame 45 is supported at the ground in its horizontal position depicted in FIGS. 5 and 6 by means of two rolls or rollers 50 which flank or straddle the entrainment member or pin 48. As already mentioned, the main frame 45 is hingedly connected to the drive unit 35 in order to upwardly pivot or rock the main frame 45, and thus also the auxiliary frame 47, there is hingedly connected to the drive unit 35 a fluid-operated cylinder unit 51, for instance a pneumatic or hydraulic cylinder unit, the piston rod 52 of which is hingedly connected at a substantially vertically disposed or upright strut or strut member 54, which is part of the main frame or frame member 45. If this fluid-operated cylinder unit 51 is impinged with a suitable pressurized fluid medium in the sense of retracting the piston rod 52, then the main frame or frame member 45, which is depicted in its downwardly pivoted or tilted horizontal position in FIG. 5, is upwardly tilted or rocked in the counterclockwise direction until assuming a substantially vertical position. This condition has been represented in FIG. 3, wherein it will be apparent that the entrainment carriage 12 with the upwardly tilted or pivoted frame members 45 and 47 is capable of traveling past a winding frame or frame member 26.

What is still to be mentioned is that for the exact lateral positioning of a winding frame 26, which has been brought into its preparatory position, there are advantageously anchored at the ground or supporting surface lateral stops or impact members 55, which coact with the base or main frame or frame member 28 of the winding frame 26.

Now in order to describe the course of the movements and the operation of the winding frame exchange apparatus reference will again be made to FIGS. 1 to 4.

As shown in FIG. 1 the illustrated winding frame or frame member 26 is located in its preparatory position, the entrainment carriage 12 is coupled to the winding frame 26, and the corners of the base frame 28, which are provided with the legs or leg members 29, are slightly raised. The part of the total weight which is normally carried by the legs or leg members 29 of the winding frame 26 which is provided with the completely wound product package 24, is now taken over by the rolls or roller 50 of the main frame 45 by virtue of the expanded bellows 49 or the like. The platform or platform member 15 is laterally shifted or moved out away from the immediate vicinity of the winding station 11. Now the transmission motor 40 is turned on or activated so as to operate in the rotational sense such that the entrainment carriage 12 together with the thereat coupled winding frame 26 is moved to the winding station 11. This movement terminates as soon as the winding frame 26 has travelled into the connection element or connection fork 56 belonging to the winding station 11. This connection element or fork 56 serves the purpose of activating the otherwise, so to speak "dead" or inoperative auxiliary units which are provided at the winding frame 26 itself and designated generally by reference character 57 in FIG. 4.

With reference now to FIG. 2, it will be observed that in the case where the winding frame or frame member 26 is operatively connected or associated with the winding station 11, the entrainment carriage 12 initially still remains in the position depicted in FIG. 2, whereas the piston-and-cylinder unit 21 is impinged with the pressurized fluid medium in the sense of retracting the piston rod 20. The platform or platform member 15 is thus moved into the preparatory position depicted in FIG. 2 at the vicinity of the winding station II. During this time the wound product package 24, which is provided in the winding frame 26 which is operatively coupled with the winding station 11, is already wound-off or depleted, and this has been indicated by the already reduced package diameter which has been depicted in FIG. 2. As soon as the wound product package 24 is empty, then the transmission motor 40 of the entrainment carriage 12, which is again coupled at the winding frame 26 is turned-on to operate in a rotational sense such that the entrainment carriage 12 and together therewith the dragged winding frame 26 is removed from the winding station 11 however, this movement continues only for such time until the now appreciably lighter winding frame 26 is located completely upon the platform or platform member 15. Thereafter, the entrainment carriage 12 decouples itself from the winding frame 26 by lowering of its entrainment member or pin 48 and moves a slight further distance away from the winding station 11.

Figure 3:
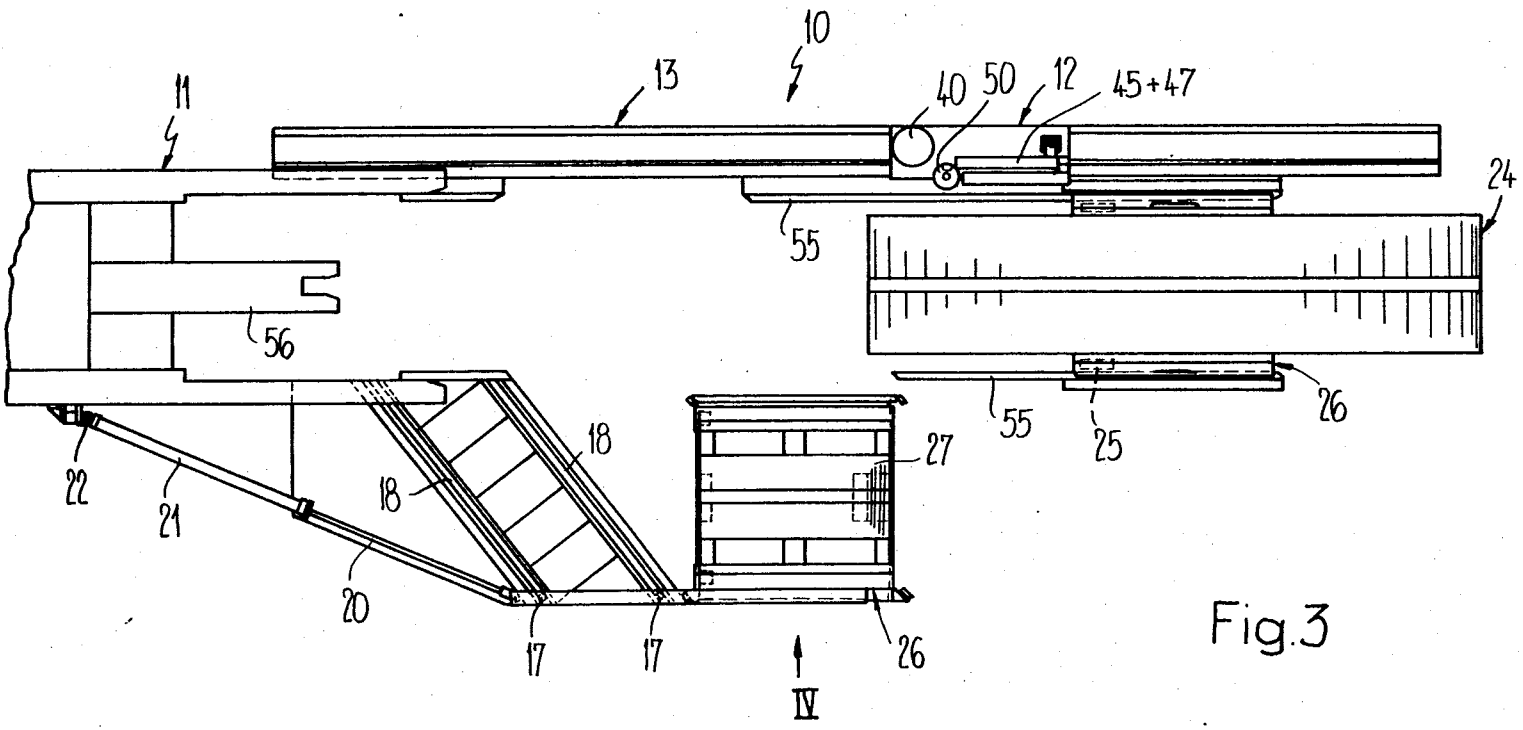
FIG. 3 is a top plan view of the winding frame exchange apparatus depicted in FIG. 2 wherein the empty winding frame which no longer contains any wound package has been retracted or moved away by means of the platform from the immediate vicinity of the winding station, and the entrainment carriage is ready to, so to speak, "retrieve" a further winding frame containing a full or completely wound package thereon.
Figure 4:
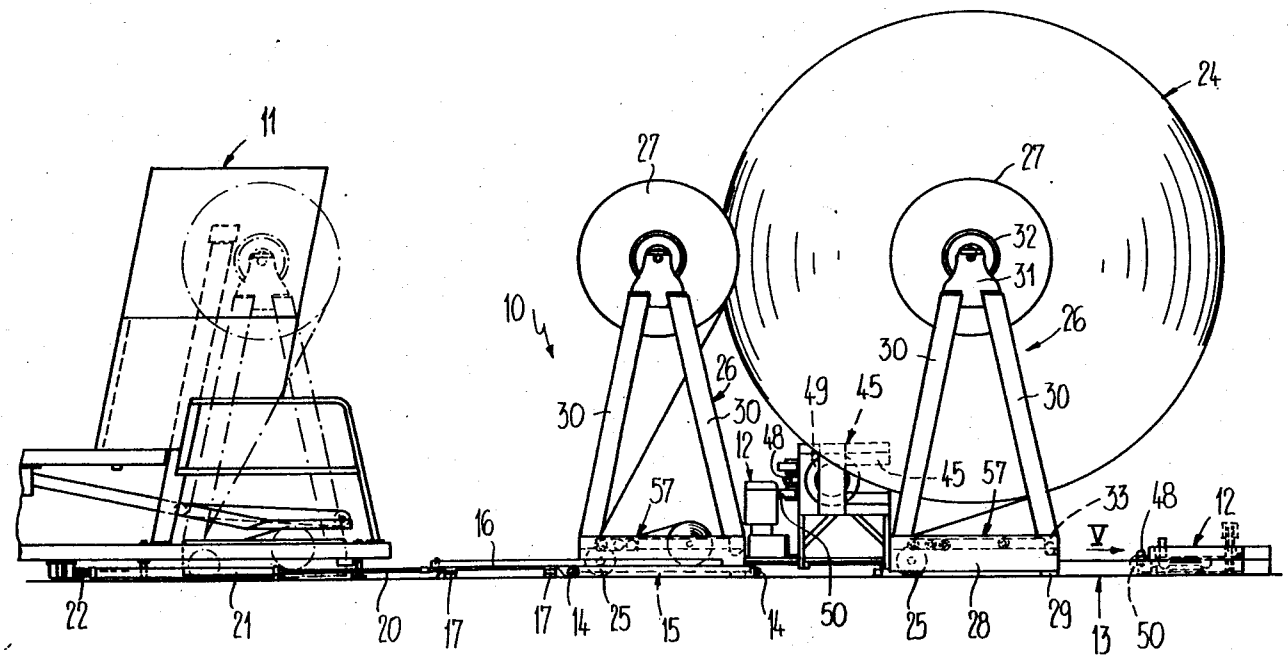
FIG. 4 is a side view of the winding frame exchange apparatus depicted in FIG. 3 looking in the direction of the arrow IV thereof, wherein at the left-hand side there is shown in chain-dot lines the empty winding frame without any wound package thereon in its coupled position, and at the right-hand side there is likewise shown in chain-dot lines the entrainment carriage at one end of its possible path of travel.

As will be observed by referring to FIG. 3 the piston-and-cylinder unit 21 is impinged with the pressurized fluid medium in the sense of thrusting out or ejecting the piston rod 20. The platform or platform member 15, which now has received and supports only the winding frame 26 which carries the empty winding core 27, is thus moved out away from the immediate vicinity of the winding station 11 into the illustrated position where the winding frame 26 is ready to be removed or picked-up, so to speak as an "empty structure". At the same time the entrainment carriage 12, through appropriate impingement of the cylinder 51 with the pressurized fluid medium, has upwardly rocked or tilted the frames 45 and 47, and moves past a further winding frame 26 containing a completely wound product package 24, which in the interim has been brought into the preparatory position between the lateral stop or impact members 55, as the same is clearly evident by referring to FIGS. 3 and 4.

As soon as the entrainment carriage 12 has "overtaken towards the rear" this further winding frame 26, then the frame or frame members 45 and 47 thereof are downwardly rocked or tilted into the substantially horizontal position. The entrainment carriage 12 now moves with the downwardly rocked or tilted frames or frame members 45 and 47 a short distance towards or in the direction of the winding station 11. Thereafter, the auxiliary frame or frame member 47 is raised in order to place the entrainment member or pin 48 into operative engagement with the entrainment recess or opening 34 in the further winding frame or frame member 26. Thereafter, this winding frame or frame member 26 is again displaced towards the winding station 11 until it arrives into operable association with the connection element or fork 56 or equivalent structure.

The course of the movements described for the product unwinding or winding-off operation occurring at the winding station 11 can also be however, converted into a movement course which is capable of carrying out a product winding-up operation, if there is proceeded from the assumption that in that case the platform or platform member 15 serves for the reception of, in each case, a comparatively light winding frame 26 having an empty winding core 27 and the entrainment carriage 12 predominantly serves for the linear displacement of a winding frame 26 carrying a full or completely wound product package 24.

It has been found that with the described apparatus, a winding frame exchange at the winding station 11 can be accomplished in a time which is appreciably less than 30 seconds, whereas the residence or dwell time at the winding station 11 of a winding frame 26 with a wound product package 24, which contains comparatively few but, in such case very thick printed products, as a general rule takes place over a number of minutes. This residence or dwell time is totally sufficient in order to retrieve an empty winding frame 26 from the platform or platform member 15, and to bring into the preparatory position between the lateral stops or impact members 55 a winding frame 26 which carries a complete or fully wound product package 24.

While there are shown and described present preferred embodiments of the invention, it is to be distinctly understood that the invention is not limited thereto, but may be otherwise variously embodied and practiced within the scope of the following claims.

Accordingly, what I claim:

1. An apparatus for use with a winding station for printed products and serving for the exchange of a mobile package frame, which is to be removed from the winding station, for a mobile winding frame which is to be coupled with the winding station, comprising:

means defining a substantially linear path of travel for an entrainment carriage;

an entrainment carriage moveable along said substantially linear path of travel;

said entrainment carriage being provided with means for coupling said entrainment carriage with an associated mobile winding frame and moveable toward said winding station and away from said winding station;

a platform for the reception of a processed winding frame; and means for guiding said platform for movement into the region of the substantially linear path of travel at the vicinity of the winding station and laterally out of said linear path of travel.

2. The apparatus as defined in claim 1, wherein:

said coupling means provided for said entrainment carriage comprises an elevationally displaceable coupling element;

a coupling element provided at said winding frame and operatively associatable with said elevationally displaceable coupling element; and said elevationally displaceable coupling element being engageable from below with the coupling element provided at the winding frame.

3. The apparatus as defined in claim 2, wherein:

said entrainment carriage includes an auxiliary frame and a main frame;

means for pivotably mounting said auxiliary frame for pivotable motion about a substantially horizontal axis directed substantially transversely with respect to the substantially linear path of travel of the entrainment carriage;

said auxiliary frame have oppositely situated end portions; and said elevationally displaceable coupling element being arranged at one end portion of said auxiliary frame and said auxiliary frame being pivotably mounted at the other oppositely situated end portion thereof at said pivotably mounting means.

4. The apparatus as defined in claim 3, wherein:

said main frame has a side extending substantially parallel to the substantially linear path of travel of the entrainment carriage;

drive means provided for said entrainment carriage;

means for hingedly connecting said side of said main frame about an axis extending substantially parallel to the substantially linear of travel of the entrainment carriage and at said drive means; and rail means for guiding said drive means; and said side of said main frame being pivotably connected by said axis extending parallel to the travel of the entrainment carriage at said drive means which is guided in said rail means.

5. The apparatus as defined in claim 4, further including:

fluid-operated means hingedly connected with said drive means; and said main frame being pivotable by said fluid-operated means from a substantially horizontal position into a substantially vertical position and visa versa.

6. The apparatus as defined in claim 5, wherein:

said main frame of said entrainment carriage comprises freely rotatable rollers for supporting said main frame on a supporting surface in substantially horizontal position.

7. The apparatus as defined in claim 4, wherein:

said drive means comprises a gear;

said drive means further comprises a drive motor for driving said gear;

a gear rack stationarily arranged at said rail means; and said gear meshing with said gear rack.

8. The apparatus as defined in claim 5, wherein:

said means for guiding said platform comprises guide rail means which are directed away from the winding station at an angle of at most 90° with respect to said substantially linear path of travel.

9. The apparatus as defined in claim 7, further including:

cantilever means operatively associated with said platform;

roller means provided for said cantilever means; and said roller means guiding said cantilever means in said guide rail means.

10. The apparatus as defined in claim 8, further including:

a piston-and-cylinder unit having opposed ends;

means for mounting one of said ends of said piston-and-cylinder unit in a predetermined spatial position;

means for hingedly connecting the other end of said piston-and-cylinder unit with said cantilever means; and said platform being moveable by means of said piston-and-cylinder unit.

11. The apparatus as defined in claim 7, wherein:

said guide rail means are substantially of linear configuration.

12. The apparatus as defined in claim 7, wherein:

said platform comprises a ground-near carriage;

said platform containing freely rotatable wheels;

each of said freely rotatable wheels having an axis of rotation which is directed substantially at right angles to the guide rail means.

13. The apparatus as defined in claim 3, further including:

fluid-operated means supported at said main frame; and said auxiliary frame being pivotable by means of said fluid-operated means.

14. The apparatus as defined in claim 12, wherein:

said fluid-operated means comprise pneumatically expansible bellows means.

15. An apparatus for use with a winding station for printed products and serving for the exchange of a mobile package frame, which is to be removed from the winding station, for a mobile winding frame which is to be coupled with the winding station, comprising:

means defining a predeterminate path of travel for an entrainment carriage;

an entrainment carriage moveable along said predeterminate path of travel;

said entrainment carriage being provided with means for coupling said entrainment carriage with an associated mobile winding frame;

means for selectively moving said entrainment carriage toward said winding station and away from said winding station along said predetrminate path of travel;

a platform for the reception of a processed winding frame; and means for guiding said platform for movement into the region of said predeterminate path of travel and laterally out of said predeterminate path of travel.

* * * * *